US008390199B2

(12) United States Patent
Chang et al.

(10) Patent No.: US 8,390,199 B2
(45) Date of Patent: Mar. 5, 2013

(54) MODE-SELECTIVE INTERACTIVE STRUCTURE FOR GYROTRONS

(75) Inventors: Tsun-Hsu Chang, Hsinchu (TW); Nai-Ching Chen, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 821 days.

(21) Appl. No.: 12/558,935

(22) Filed: Sep. 14, 2009

(65) Prior Publication Data

US 2011/0018435 A1 Jan. 27, 2011

(30) Foreign Application Priority Data

Jul. 24, 2009 (TW) ..... 98124992 A

(51) Int. Cl.
*H01J 25/00* (2006.01)

(52) U.S. Cl. ..... 315/4; 315/5; 315/5.31

(58) Field of Classification Search ..... 315/4, 5, 315/5.29, 5.31, 5.32, 5.33, 5.49, 5.53, 39; 331/79; 333/227, 230, 231
See application file for complete search history.

(56) References Cited

U.S. PATENT DOCUMENTS

| | | | | | |
|---|---|---|---|---|---|
| 4,282,458 | A | * | 8/1981 | Barnett | 315/4 |
| 4,398,121 | A | * | 8/1983 | Chodorow et al. | 315/4 |
| 4,445,070 | A | * | 4/1984 | Wachtel | 315/4 |
| 4,839,561 | A | * | 6/1989 | Ito | 315/4 |
| 5,038,077 | A | * | 8/1991 | Gold et al. | 315/5.39 |
| 5,138,230 | A | * | 8/1992 | Jodicke et al. | 315/5 |
| 5,814,940 | A | * | 9/1998 | Fujisawa | 315/5.41 |

OTHER PUBLICATIONS

Chen et al., "A mode-selective circuit for $TE_{01}$ gyrotron backward-wave oscillator with wide-tuning range," Applied Physics Letters, 94, 101501 (2009).

* cited by examiner

*Primary Examiner* — Tung X Le
(74) *Attorney, Agent, or Firm* — Muncy, Geissler, Olds & Lowe, PLLC

(57) ABSTRACT

A mode-selective interactive structure for gyrotrons includes a plurality of metal tubes, wherein an inner wall of each metal tube forms a waveguide; and between each adjacent pair of the metal tubes exists a slice with a first interface and a second interface and when an electromagnetic wave comprising an operating mode and a competing mode propagates through the slice, the competing mode is partially reflected upon, partially transmitted through and/or absorbed at the first interface and the second interface of the slice so that the power loss of the competing mode is larger than the operating mode and the production of the competing modes is suppressed progressively thereby achieving mode selection.

19 Claims, 6 Drawing Sheets

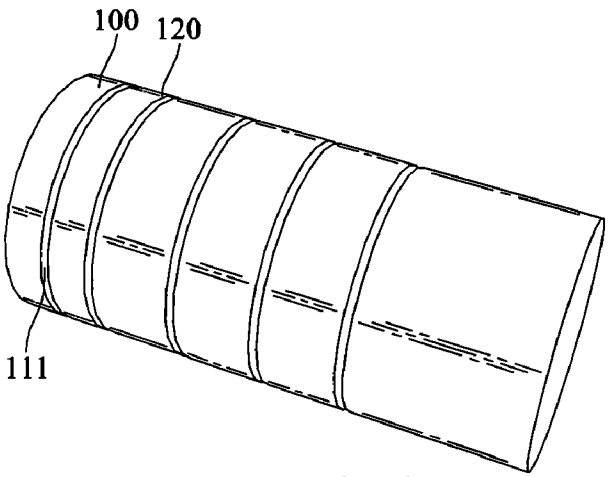
FIG.(6a)
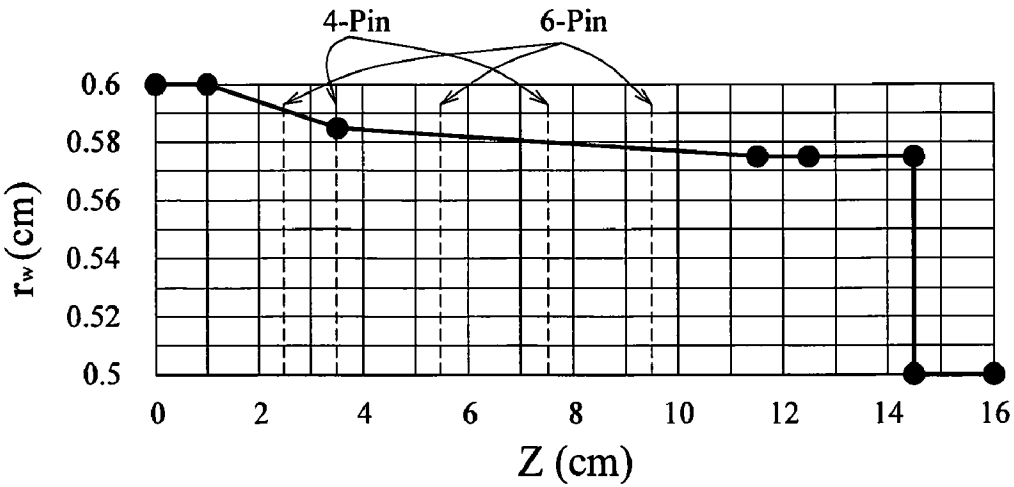
FIG.(6b)

MODE-SELECTIVE INTERACTIVE STRUCTURE FOR GYROTRONS

BACKGROUND OF THE INVENTION

1. Field of the Invention

The present invention relates to an interactive structure for gyrotrons, more particularly to a mode-selective interactive structure for gyrotrons.

2. Description of the Related Art

In order for a gyrotron to provide terahertz-wave radiation with super high output power, a high-order mode instead of a fundamental mode is used as an operating mode of the gyrotron. However, since the cutoff frequencies of adjacent high-order transverse modes are close, severe mode competition may hamper the performance of the gyrotron.

FIG. 1 is a frequency f to propagation constant $k_z$ diagram illustrating the competing modes that may be produced when tuning the operating frequency of a gyrotron, wherein curved lines represents different modes exist in the waveguide structure of the gyrotron, and sloped lines are the fundamental (s=1) and second (s=2) cyclotron harmonic beam-wave resonance lines. The oscillation occurs at where a mode-representing curved line intersects with a beam-wave resonance line. For example, suppose a high-order mode such as $TE_{01}$ mode is the operating mode of the gyrotron, represented using a solid curved line, the oscillations occur at where the curved line representing the $TE_{01}$ mode intersects with the s=1 beam-wave resonance line. However, the s=1 beam-wave resonance line also intersects with the curved line of other modes such as $TE_{21}$ mode and $TE_{31}$ mode; as a result, parasitic oscillations from $TE_{21}$ mode and $TE_{31}$ may occur within the operating region of the electron beam, a phenomenon known as mode competition. Besides, when the gyrotron changes the operating frequency by adjusting the magnetic field, the s=1 beam-wave resonance line is translated vertically and intersects with the curved line of $TE_{01}$ mode at different frequencies, resulting in new competition modes such as $TE_{41}$.

A prior art gyrotron disposes a groove on the wall of a circular waveguide or a resonance cavity so that when passing by the groove, a circular mode such as $TE_{01}$, which has a wall surface current surrounding the central axis of the waveguide, is not affected, while a competing mode, which has a wall surface current in the axial direction, is substantially affected; hence, the propagation of the competing mode is hampered.

The prior art gyrotron has not arranged any lossy material or has arranged a low resistive loss material for the groove because the super high power absorbed may burn any lossy material. It relies on reflecting the competing modes by the groove to diverge the competing modes, but in such way, the competing modes may still exist and compete with the operating mode. Besides, the prior art gyrotron may need to shorten its interactive section in order to suppress the production of competing modes, and thus reduce the room for output power optimization.

In order to solve the aforementioned problems, the present invention is directed to providing a mode-selective interactive structure for gyrotrons which is capable of suppressing competing modes so that the operating mode may stand out from the mode competition thereby achieving mode selection.

SUMMARY OF THE INVENTION

The present invention is directed to providing a mode-selective interactive structure for gyrotrons which is equipped with at least a slice so that the power loss of the competing modes is larger than the power loss of the operating mode when passing through each slice, and the production of the competing modes is suppressed progressively thereby achieving mode selection.

According to one embodiment of the present invention, a mode-selective interactive structure for gyrotrons includes a plurality of metal tubes, wherein an inner wall of each metal tube forms a waveguide; and between each adjacent pair of the metal tubes exists a slice with a first interface and a second interface and when an electromagnetic wave including an operating mode and a competing mode propagates through the slice, the competing mode is partially reflected upon, partially passed through and/or absorbed at the first interface and the second interface of the slice so that the power loss of the competing mode is larger than the operating mode.

Additionally, according to one embodiment of the present invention, for each different slice of the mode-selective interactive structure for gyrotrons, the distance between the first interface and the second interface is different so as to increase the power loss when the electromagnetic wave includes a plurality of competing modes with different frequencies.

According to another embodiment of the present invention, the distance between the first interface and the second interface of at least one slice renders the competing mode resonant between the first interface and the second interface.

Additionally, according to one embodiment of the present invention, the mode-selective interactive structure for gyrotrons further includes at least one metal blocking component disposed between at least one adjacent pair of the metal tubes so that each metal blocking component blocks the electromagnetic wave from transmitting through the second interface of the slice between each adjacent pair of the metal tubes respectively, wherein the second interface coincide with a surface of the metal blocking component, the surface which faces toward the central axis of the metal tubes.

Additionally, according to one embodiment of the present invention, the mode-selective interactive structure for gyrotrons further includes a lossy material wherein for at least one metal blocking component, the lossy material is disposed on the surface of each metal blocking component, and/or the nearby end surface of at least one adjacent metal tube of each metal blocking component.

Alternatively, according to another embodiment of the present invention, the mode-selective interactive structure for gyrotrons further includes a lossy material wherein for at least one metal blocking component, the lossy material is filled in each metal blocking component and forms the surface of each metal blocking component, and/or the lossy material is filled in at least one adjacent metal tube of each metal blocking component and forms the nearby end surface of at least one adjacent metal tube of each metal blocking component.

According to different embodiments of the present invention, the nearby end surface of at least one adjacent metal tube of the slice may be vertical or slanted, and regular or irregular.

According to one embodiment of the present invention, the distance between end surfaces of the adjacent metal tubes of the slice is smaller than half of the wavelength of the operating mode with the minimum frequency.

BRIEF DESCRIPTION OF THE DRAWINGS

FIG. 6*a* is a schematic diagram illustrating the side view of the mode-selective interactive structure for gyrotrons according to an embodiment after assembly; and FIG. 6*b* is a diagram illustrating an embodiment where the radius of the waveguide changes with respect to the length of the interactive structure.

DETAILED DESCRIPTION OF THE INVENTION

The objectives, technical contents and characteristics of the present invention can be more fully understood by reading the following detailed description of the preferred embodiments, with reference made to the accompanying drawings.

Figure 1:
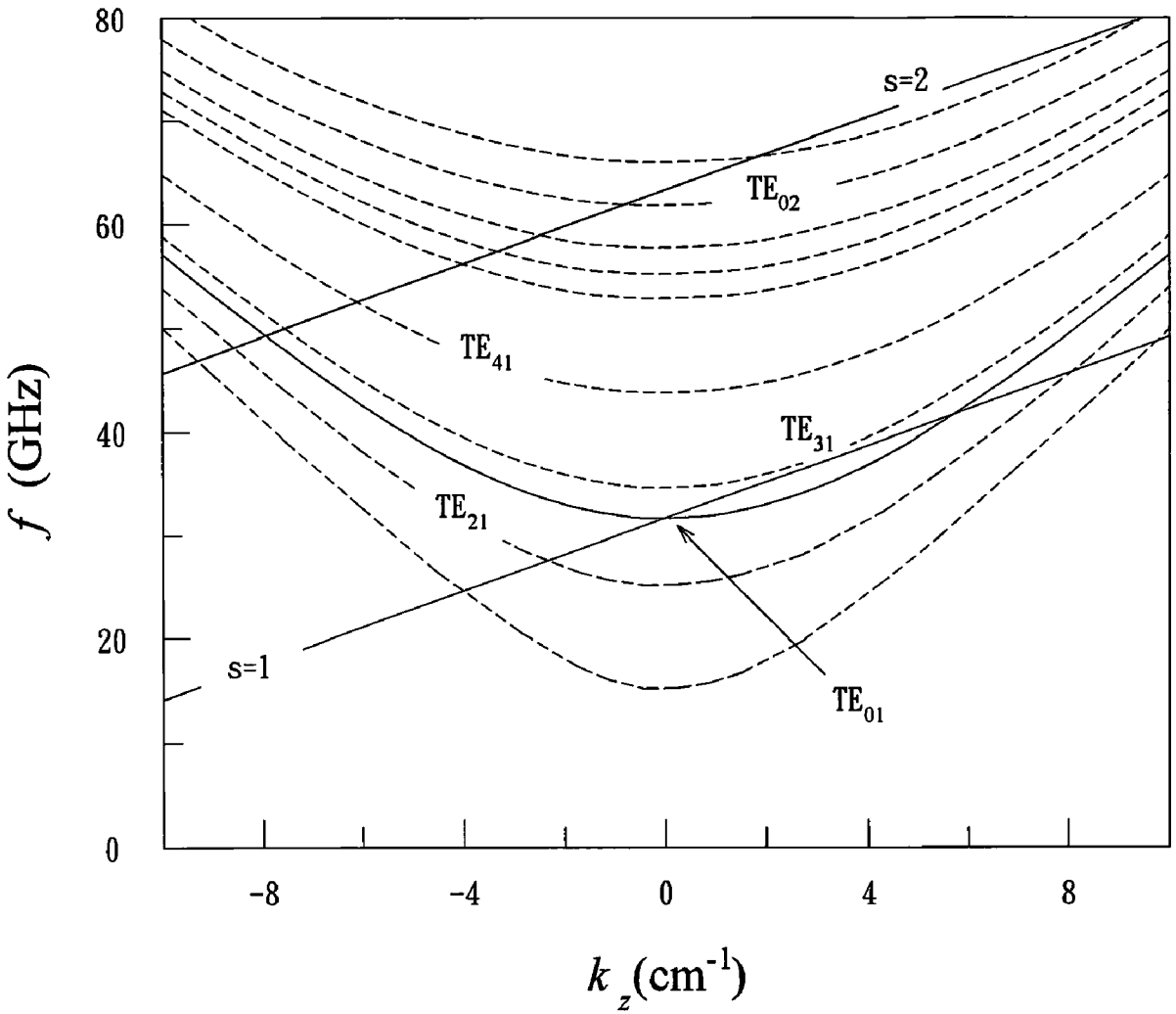
FIG. 1 is a frequency f-propagation constant $k_z$ diagram illustrating the competing modes which may be produced when tuning the operating frequency of a gyrotron.
Figure 2:
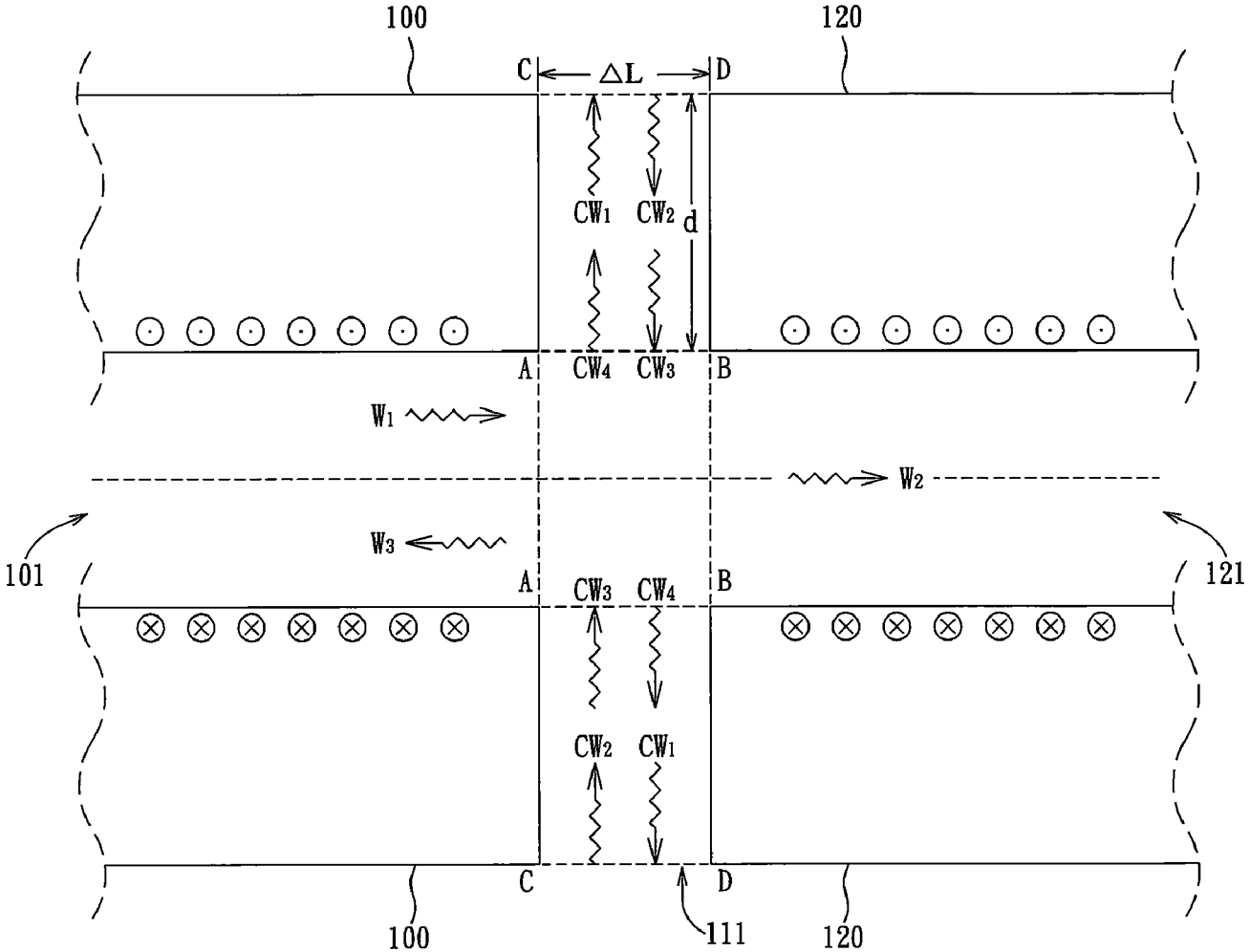
FIG. 2 is a schematic diagram illustrating the cross sectional view of a portion of the mode-selective interactive structure for gyrotrons from a side according to an embodiment.

FIG. 2 is a schematic diagram illustrating the cross sectional view of a portion of the mode-selective interactive structure for gyrotrons from a side according to an embodiment. In this embodiment, the mode-selective interactive structure for gyrotron includes a plurality of metal tubes, such as metal tubes 100 and 120 shown in the figure, wherein an inner wall of each metal tube 100, 120 forms a waveguide 101, 121; the waveguides 101 and 121 are aligned; and between each adjacent pair of the metal tubes 100 and 120 exists a slice 111 with a first interface AB and a second interface CD. According to one embodiment as shown in FIG. 2, the first interface AB of the slice 111 refers to a surface extended from an inner rim of the nearby end surface of either adjacent metal tube 100, 120 of the slice 111 toward the slice 111; the second interface CD of the slice 111 refers to a surface extended from an outer rim of the nearby end surface of either adjacent metal tube 100, 120 of the slice 111 toward the slice 111. According to one embodiment, the cross-section of the inner wall of each metal tube 100, 120 can be but not limited to circular; i.e. each waveguide 101, 121 is a circular waveguide.

Referring to FIG. 2, in this embodiment, when an electromagnetic wave $W_1$ of any mode incidents on the slice 111, a portion of it, represented by $W_2$ in the figure, transmits through the slice 111; a portion of it, represented by $W_3$ in the figure, is reflected by the slice 111; and a portion of it couples with the slice 111 and becomes a coupling wave CW. Then the coupling wave $CW_1$ incidents on a discontinuous surface, i.e. the second interface CD, when propagating. A portion of the coupling wave $CW_1$ is passed through the second interface CD, and a portion of it is reflected by the second interface CD as the coupling wave $CW_2$. The coupling wave $CW_2$ transmits to the first interface AB and becomes the coupling wave $CW_3$ incidenting on the first interface AB. A portion of the coupling wave $CW_3$ is passed through the first interface AB, and a portion of it is reflected by the first interface AB as the coupling wave $CW_4$. The coupling wave $CW_4$ then incidents again on the second interface CD and so on. In such way, the coupling wave CW experience multiple reflections between the first interface AB and the second interface CD, and diminishes round by round.

Figure 3:
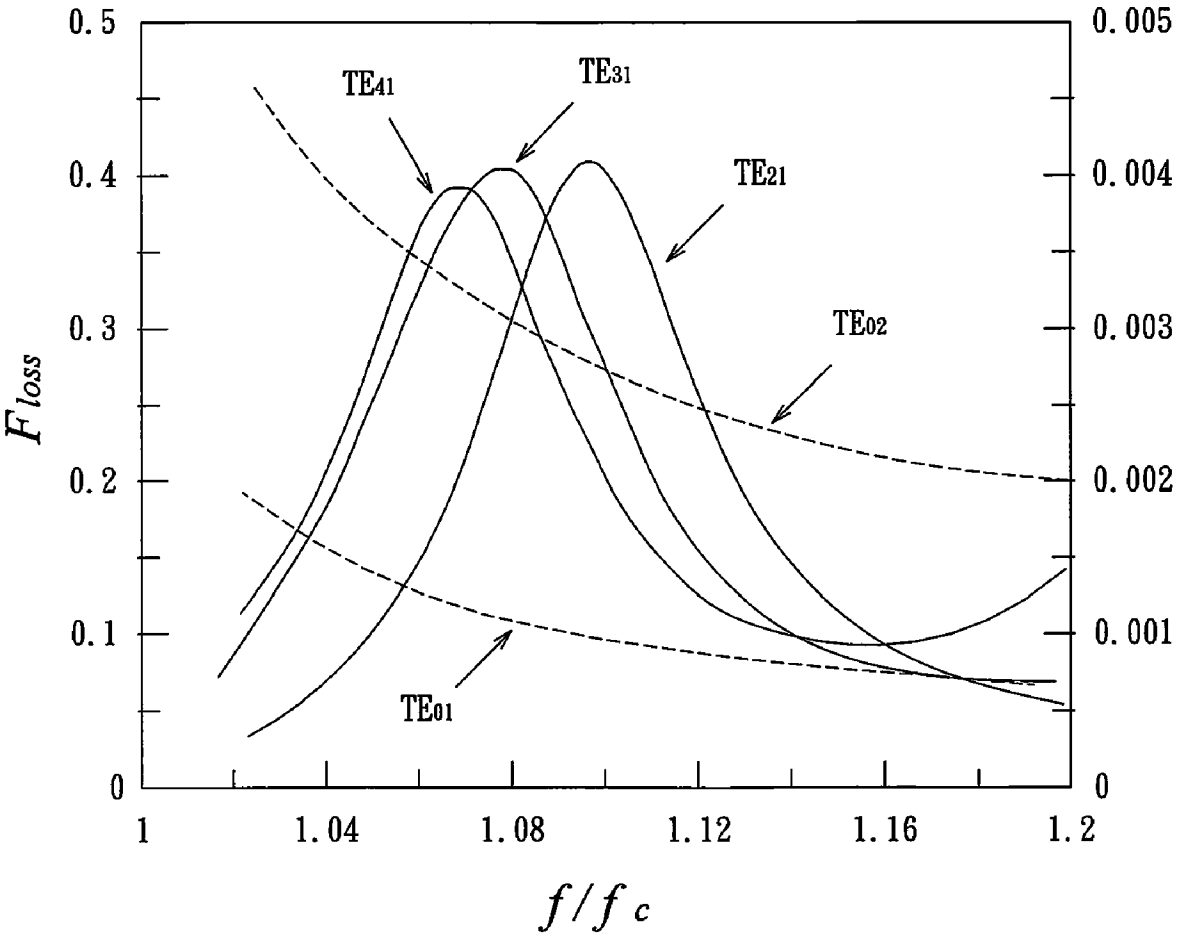
FIG. 3 is a power loss factor $F_{loss}$-frequency f diagram for different modes propagating through the slice according to an embodiment.

As a result, for an electromagnetic wave $W_1$ of any mode incidenting on the slice 111, a power loss factor $F_{loss}$ can be calculated, as shown in equation (1)

$$F_{loss} = \frac{P_{w1} - P_{w2} - P_{w3}}{P_{w1}} \tag{1}$$

wherein $P_{w1}$, $P_{w2}$, and $P_{w3}$ are respectively the power of the electromagnetic wave $W_1$, $W_2$ and $W_3$. FIG. 3 is a power loss factor $F_{loss}$-frequency f diagram for different modes propagating through the slice 111, wherein on the x-axis is the normalized frequency ($f/f_c$) of the electromagnetic wave, with $f_c$ being the respective cutoff frequency of each mode, and on the y-axis is the power loss factor $F_{loss}$. The modes represented by the solid lines correspond to the scale on the left, and the modes represented by the dotted lines correspond to the scale on the right. As shown in FIG. 3, each different mode has different power loss at the slice 111; therefore, by selecting an operating mode that has smaller power loss than that of its competing modes, the competing modes are progressively inhibited to be produced, and the operating mode may stand out from the competition thereby achieving mode selection.

For example, for circular waveguides, when propagating through the slice 111, the power loss of circular modes such as $TE_{01}$, $TE_{02}$ are two orders of magnitude smaller than other modes such as $TE_{21}$, $TE_{31}$ and $TE_{41}$, as shown in FIG. 3. Therefore, the slice 111 selects modes of circular electric field such as $TE_{0n}$ modes more optimally. This is due to the fact that when a circular mode passes through the slice 111, its wall surface current surrounding the central axis of the metal tube (in FIG. 2, ⊙ denotes the direction of the current coming out of the paper, and ⊗ denotes the direction going into the paper) is almost not affected, while when another mode such as $TE_{21}$, $TE_{31}$ or $TE_{41}$ passes through the slice 111, its wall surface current in axial direction is significantly affected.

It is empathetically noted that although the present embodiment has better selection effect for circular modes, the present invention is not limited to use circular modes $TE_{0n}$ as the operating mode. As long as the power loss factor $F_{loss}$ of a mode is relatively lower than that of its competing modes, it may be chosen as the operating mode. Additionally, according to one embodiment, as shown in FIG. 2, the distance ΔL between nearby end surfaces of the adjacent metal tubes 100 and 120 of the slice 111 is smaller than half of the wavelength of the operating mode with the minimum frequency so that the slice 111 would not allow the operating mode to propagate out from the second interface CD and therefore, the power loss of the operating mode resulted from the slice 111 is reduced.

Besides, referring to FIG. 2, the coupling wave CW undergoes multiple reflections between the first interface AB and the second interface CD, making the slice 111 behave like an open resonator. When the resonant frequency of the open resonator match with the frequency of the coupling wave CW, the power loss factor $F_{loss}$ of the coupling wave CW is the highest. As shown in FIG. 3, the highest power loss of modes $TE_{21}$, $TE_3$, and $TE_4$, are 0.4, meaning that 40% of the power of such competing modes is dissipated by a single slice. Moreover, to further increase the power loss of a competing mode, the number of slices can be increased.

One of the factors that determine the resonant frequency is the distance d between the first interface AB and the second interface CD in FIG. 2. Hence, slices of different resonant frequencies targeting different competing modes can be formed by modifying distance d between the first interface AB and the second interface CD. Therefore, slices of resonant frequencies targeting newly generated competing modes encountered when changing the operating frequency can be added easily to allow a wider tuning range.

In the embodiment shown in FIG. 2, the nearby end surface of the metal tubes 100 and 120 of the slice 111 is vertical. In different embodiments, the nearby end surface of at least one adjacent metal tube 100, 120 of the slice 111 may be vertical or slanted, and regular or irregular.

Figure 4:
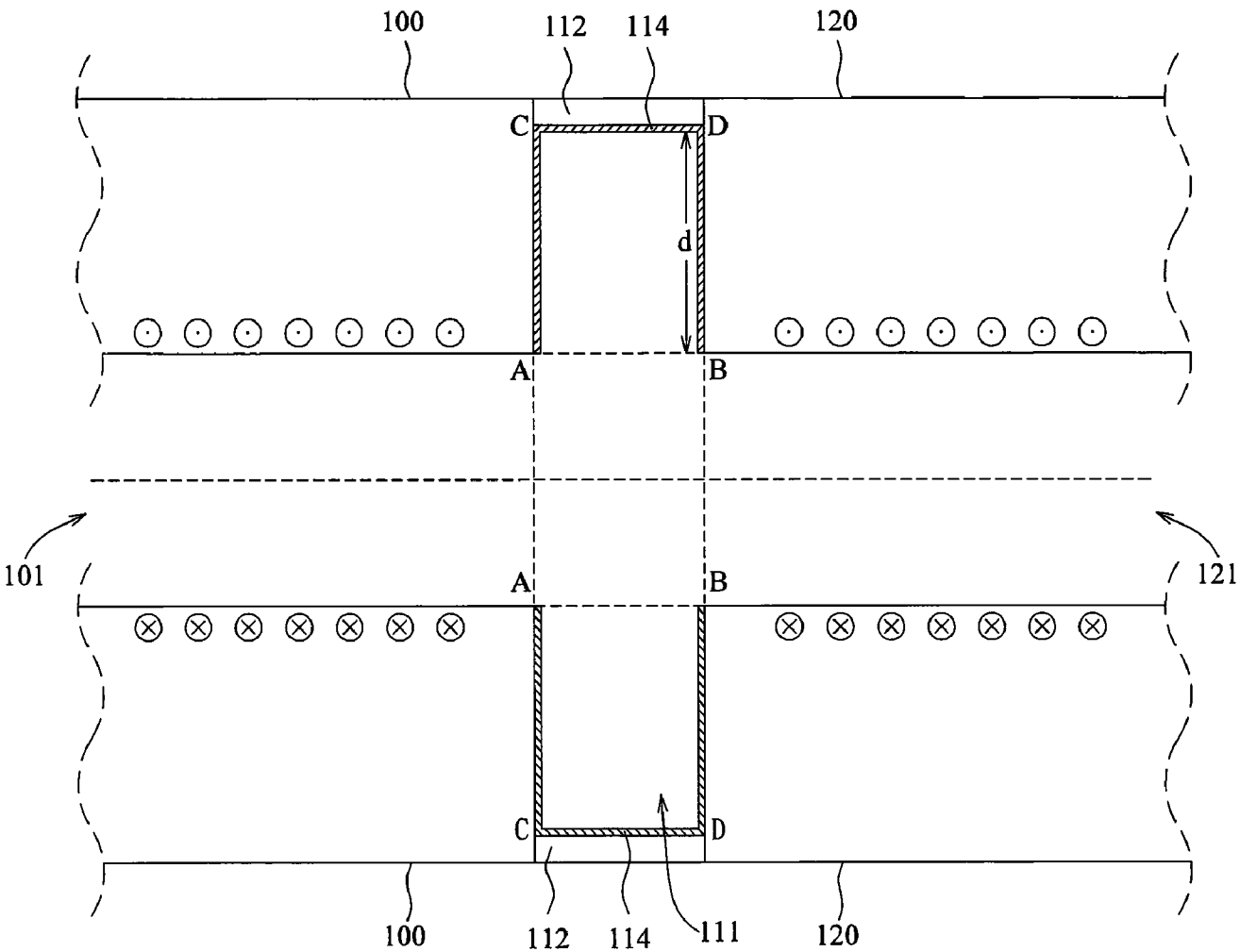
FIG. 4 is a schematic diagram illustrating the cross sectional view of a portion of the mode-selective interactive structure for gyrotrons from a side according to another embodiment.

FIG. 4 is a schematic diagram illustrating a cross sectional view of a portion of the mode-selective interactive structure for gyrotrons from a side according to another embodiment. In this embodiment, the mode-selective interactive structure for gyrotrons further includes at least one metal blocking component, such as 112 in the figure, disposed between at least one adjacent pair of the metal tubes 100 and 120 so that each metal blocking component 112 blocks the electromagnetic wave from transmitting through the second interface CD of the slice 111 between each adjacent pair of the metal tubes 100 and 120 respectively, wherein the second interface CD coincides with a surface of the metal blocking component 112, the surface which faces toward the central axis of the metal tubes 100, 120.

Additionally, according to one embodiment, as shown in FIG. 4, the mode-selective interactive structure for gyrotrons further includes a lossy material 114 wherein for at least one metal blocking component 112, the lossy material 114 may be disposed on the surface of each metal blocking component 112, and/or the nearby end surface of at least one adjacent metal tube 100, 120 of each metal blocking component 112. Alternatively, for at least one metal blocking component 112, the lossy material 114 may be filled in each metal blocking component 112 and forms the surface of each metal blocking component 112, and/or the lossy material 114 may be filled in at least one adjacent metal tube 100, 120 of each metal blocking component 112 and forms the nearby end surface of at least one adjacent metal tube 100, 120 of each metal blocking component 112. Of course, with respect to the embodiment without the metal blocking component 112, for at least one slice 111, the lossy material 114 may be disposed on the nearby end surface of at least one adjacent metal tube 100, 120 of each slice 111, or the lossy material may be filled in at least one adjacent metal tube 100, 120 of each slice 111 and forms the nearby end surface of at least one adjacent metal tube 100, 120 of each slice 111. A nonlimiting example of the lossy material 114 is Aquadaq. As mentioned above, when the power loss of competing modes is larger than that of the operating mode, the operating mode would stand out from the competition and the production of competing modes is suppressed. That is to say, it is unlikely for the lossy material 114 to absorb such high amount of power from the competing modes to get burned.

Figure 5A:
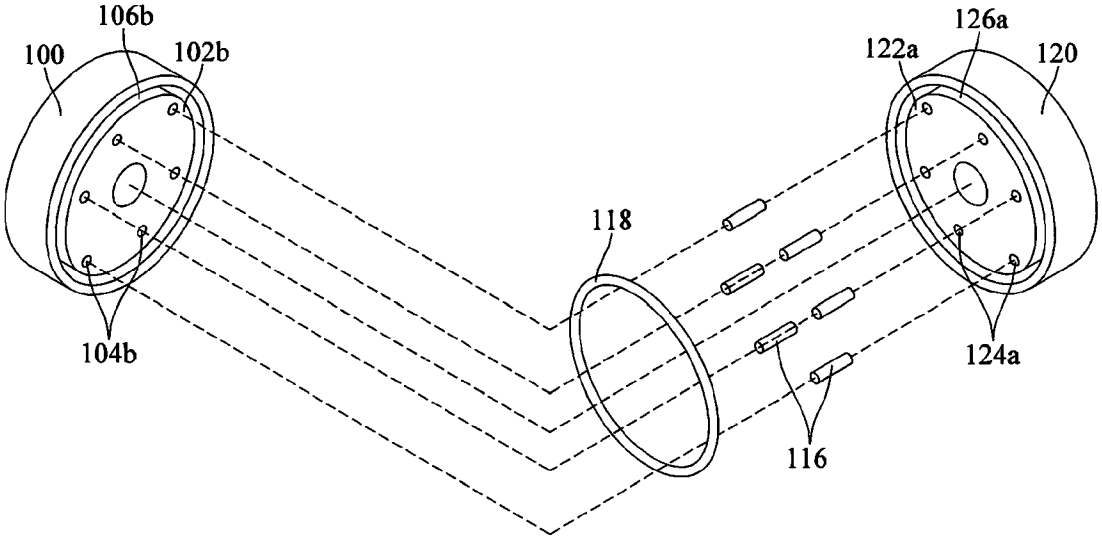
FIG. 5*a* is a schematic diagram illustrating the exploded view of the mode-selective interactive structure for gyrotrons according to an embodiment.

FIG. 5*a* is a schematic diagram illustrating the exploded view of the mode-selective interactive structure for gyrotrons according to an embodiment. In this embodiment, the mode-selective interactive structure for gyrotrons further includes a plurality of connecting components 116 arranged between the nearby end surfaces of the adjacent metal tubes 100 and 120 of each slice 111 so as to connect the plurality of metal tubes 100, 120. Corresponding connecting slots 104*b*, 124*a* are disposed on the nearby end surfaces of the adjacent metal tubes 100 and 120 of each slice 111.

Figure 5B:
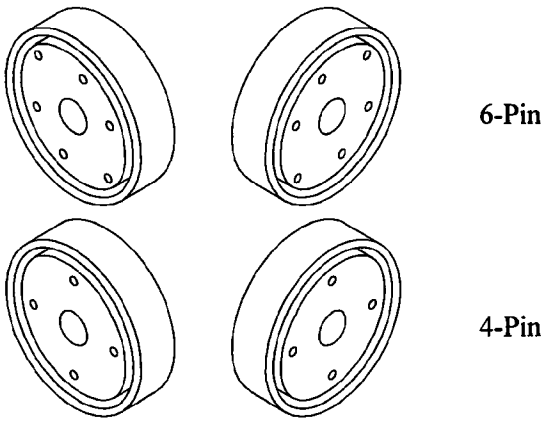
FIG. 5*b* is a schematic diagram illustrating metal tubes with different connection positions according to one embodiment.

According to different embodiments, referring to FIG. 5*a*, connecting slots 104*b*, 124*a* may be arranged at positions that the connecting components 116 least or most interfere with the propagation of the competing mode out through the slice 111. FIG. 5*b* is a schematic diagram illustrating metal tubes with different connection positions respectively for different competing modes according to an embodiment. In this embodiment, the inner waveguide of each metal tube is circular, and $TE_{01}$ mode is selected as the operating mode. The 4-pin interface and the 6-pin interface are specifically designed to least interfere with the competing mode $TE_{21}$ and $TE_{31}$, respectively.

According to one embodiment, in order to maintain each slice and waveguide in vacuum, a groove 106*b*, 126*a* is formed on the end surface of each metal tube 100, 120 to allow an air sealing component 118, which can be but not limited to an O-ring, to keep the waveguide 101, 121 of each metal tube 100, 120 and the slice 111 airtight. In other embodiments, the air sealing component 118 may be disposed on the outer surface of the metal tubes 100, 120 and wraps the slice 111; or an airtight outer tube may be used to encapsulate the metal tubes 100, 120.

FIG. 6*a* is a schematic diagram illustrating the side view of the mode-selective interactive structure for gyrotrons according to an embodiment after assembly, wherein waveguides in the metal tubes are circular. According to an embodiment, the metal tubes may have a cylindrical shape. In other embodiments, the metal tubes may have any shape such as a cone shape and a rectangular shape.

FIG. 6*b* is a diagram illustrating an embodiment where the radius $r_w$ of the waveguide changes with respect to the length Z of the interactive structure. As shown in FIG. 6*b*, in order to optimize the output power of the interactive structure, the radius $r_w$ of the waveguide gradually changes with respect to the length Z of the interactive structure. With the addition of mode-selective slices, which are located at the dotted lines in the figure, the production of competing modes is suppressed. Also, the number of slices can be increased to better suppress the competing modes so that the length Z of the interactive structure may be increased without triggering mode competition thereby providing more room for output power optimization.

In addition, in order to provide a continuous tuning range for the operating frequency, slices targeting modes of different frequencies can be arranged. As shown in FIG. 6*b*, since the radius $r_w$ of the waveguide gradually changes with respect to the length Z of the interactive structure, the slices may be arranged at positions where the distance between the first interface and the second interface of the slices render different competing modes resonant therebetween, respectively. Also, slices targeting different competing modes such as $TE_{21}$, $TE_{31}$ may use specifically designed interfaces such as 4-pin, 6-pin.

Example applications of the mode-selective interactive structure for gyrotrons according to the present invention are gyromonotron, gyroklystron, gyrotron traveling-wave tube amplifier, or gyrotron backward-wave oscillator.

In conclusion, the present invention discloses a mode-selective interactive structure for gyrotrons including a plurality of metal tubes, wherein an inner wall of each metal tube forms a waveguide; the waveguides of metal tubes are aligned; and between each adjacent pair of the metal tubes exists a slice with a first interface and a second interface and when an electromagnetic wave including an operating mode and a competing mode propagates through the slice, the competing mode is partially reflected upon, partially passed through and/or absorbed at the first interface and the second interface of the slice so that the power loss of the competing mode is larger than the operating mode. In addition, the distance between the first interface and the second interface of the slice may be designed so a competing mode resonates between the first interface and the second interface of the slice. Also, slices of different resonant frequencies targeting different competing modes may be combined to increase the continuous tuning range of the operating frequency. The length of the interactive region of gyrotrons may therefore be increased to enhance output power optimization.

The embodiments described above are to demonstrate the technical contents and characteristics of the preset invention to enable the persons skilled in the art to understand, make, and use the present invention. However, it is not intended to limit the scope of the present invention. Therefore, any equivalent modification or variation according to the spirit of the present invention is to be also included within the scope of the present invention.

What is claimed is:

1. A mode-selective interactive structure for gyrotrons comprising: a plurality of metal tubes, wherein an inner wall of each metal tube forms a waveguide; and between each adjacent pair of the metal tubes exists a slice with a first interface and a second interface and when an electromagnetic wave comprising an operating mode and a competing mode propagates through the slice, the competing mode is partially reflected upon, partially transmitted through and absorbed at the first interface and the second interface of the slice so that the power loss of the competing mode is larger than that of the operating mode.

2. The mode-selective interactive structure for gyrotrons according to claim 1 wherein the electromagnetic wave comprises a plurality of competing modes with different frequencies, and for each different slice, the distance between the first interface and the second interface is different so as to increase the power loss of the competing modes with different frequencies.

3. The mode-selective interactive structure for gyrotrons according to claim 1 wherein the first interface of the slice refers to a surface extended from an inner rim of the nearby end surface of either adjacent metal tube of the slice toward the slice.

4. The mode-selective interactive structure for gyrotrons according to claim 1, wherein the second interface of the slice refers to a surface extended from an outer rim of the nearby end surface of either adjacent metal tube of the slice toward the slice.

5. The mode-selective interactive structure for gyrotrons according to claim 1, wherein the distance between the first interface and the second interface of at least one slice renders the competing mode resonant between the first interface and the second interface.

6. The mode-selective interactive structure for gyrotrons according to claim 5, further comprising at least one metal blocking component disposed between at least one adjacent pair of the metal tubes so that each metal blocking component blocks the electromagnetic wave from transmitting through the second interface of the slice between each adjacent pair of the metal tubes respectively, wherein the second interface coincide with a surface of the metal blocking component, the surface which faces toward the central axis of the metal tubes.

7. The mode-selective interactive structure for gyrotrons according to claim 6 further comprising a lossy material wherein for at least one metal blocking component, the lossy material is disposed on the surface of each metal blocking component, and/or the nearby end surface of at least one adjacent metal tube of each metal blocking component.

8. The mode-selective interactive structure for gyrotrons according to claim 6 further comprising a lossy material wherein for at least one metal blocking component, the lossy material is filled in each metal blocking component and forms the surface of each metal blocking component, and/or the lossy material is filled in at least one adjacent metal tube of each metal blocking component and forms the nearby end surface of at least one adjacent metal tube of each metal blocking component.

9. The mode-selective interactive structure for gyrotrons according to claim 1 wherein the nearby end surface of at least one adjacent metal tube of the slice is vertical or slanted.

10. The mode-selective interactive structure for gyrotrons according to claim 1 wherein the nearby end surface of at least one adjacent metal tube of the slice is regular or irregular.

11. The mode-selective interactive structure for gyrotrons according to claim 1, wherein the distance between nearby end surfaces of the adjacent metal tubes of the slice is smaller than half of the wavelength of the operating mode with the minimum frequency.

12. The mode-selective interactive structure for gyrotrons according to claim 1 further comprising a lossy material wherein for at least one slice, the lossy material is disposed on the nearby end surface of at least one adjacent metal tube of each slice.

13. The mode-selective interactive structure for gyrotrons according to claim 1 further comprising a lossy material wherein for at least one slice, the lossy material is filled in at least one adjacent metal tube of each slice and forms the nearby end surface of at least one adjacent metal tube of each slice.

14. The mode-selective interactive structure for gyrotrons according to claim 1 further comprising a plurality of connecting components arranged between the nearby end surfaces of the adjacent metal tubes of each slice, so as to connect the plurality of metal tubes.

15. The mode-selective interactive structure for gyrotrons according to claim 14, wherein the plurality of connecting components are arranged at positions least interfering with the propagation of the competing mode out through the slice.

16. The mode-selective interactive structure for gyrotrons according to claim 1 further comprising at least one air sealing component for maintaining the waveguide of each metal tube and each slice airtight.

17. The mode-selective interactive structure for gyrotrons according to claim 1, wherein the inner wall of each metal tube has a circular cross-section.

18. The mode-selective interactive structure for gyrotrons according to claim 17, wherein the operating mode is a $TE_{0n}$ mode with circular electric field.

19. The mode-selective interactive structure for gyrotrons according to claim 1 may be applied to gyromonotron, gyroklystron, gyrotron traveling-wave tube amplifier, or gyrotron backward-wave oscillator.

* * * * *